US006476772B1

(12) United States Patent
Smith et al.

(10) Patent No.: US 6,476,772 B1
(45) Date of Patent: Nov. 5, 2002

(54) WAVEGUIDE SLOT ARRAY CAPABLE OF RADIATING SHAPED BEAMS

(75) Inventors: Terry M. Smith, La Honda, CA (US); George Hardie, Santa Barbara, CA (US); Juan Duarte, McCall, ID (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/835,795

(22) Filed: Apr. 16, 2001

(51) Int. Cl.[7] ..... H01Q 13/10
(52) U.S. Cl. ..... 343/771; 343/770; 333/114
(58) Field of Search ..... 343/771, 776, 343/778, 786, 772, 777, 770; 333/114

(56) References Cited

U.S. PATENT DOCUMENTS 4,429,313 A * 1/1984 Muhs, Jr. et al. ..... 343/771
5,926,147 A * 7/1999 Sehm et al. ..... 343/776
6,304,228 B1 * 10/2001 Smith et al. ..... 343/771

* cited by examiner

*Primary Examiner*—Don Wong
*Assistant Examiner*—James Clinger
(74) *Attorney, Agent, or Firm*—Kenneth W. Float

(57) ABSTRACT

A waveguide slot array antenna system, for use with a communications system 30 disposed on a satellite. The waveguide slot array antenna system comprises a feed waveguide having an input port and multiple output ports, a waveguide slot array having a plurality of slots formed therein that is coupled to the feed waveguide, and a waveguide lens disposed adjacent to the waveguide slot array. The phase of each contributing radiating waveguide is controlled to achieve radiation pattern shaping. Inner dimensions of the rectangular waveguides are designed to provide a phase velocity inside each waveguide that results in the appropriate radiated phase at the output of the waveguides. The phase radiated by each rectangular waveguide is determined by design, and the radiation pattern that results from the combined contributions of the array can be shaped to produce a complex radiation contour. This significantly increases the efficiency with which signals are directed to intended regions without coverage directed to unintended regions.

14 Claims, 5 Drawing Sheets

WAVEGUIDE SLOT ARRAY CAPABLE OF RADIATING SHAPED BEAMS

BACKGROUND

The present invention relates generally to spacecraft communication systems, and more particularly, to a waveguide slot array antenna system that is capable of radiating shaped beams.

The assignee of the present invention manufactures and deploys communication satellites. Such communication satellites carry communication systems and antennas that are used to communicate with ground-based communication devices. Heretofore, communication systems have employed conventional waveguide slot array designs.

The closest known prior art relating to the present invention is the conventional waveguide slot array. This well-known design radiates in-phase signal contributions from each slot in the array and is therefore restricted to simple circular or elliptical beam shapes.

It would therefore be desirable to have a waveguide slot array that may be advantageously used in a satellite-based communication system and that provides for shaped radiated beam profiles. It is therefore an objective of the present invention to provide for a waveguide slot array antenna system that is capable of radiating shaped beams.

SUMMARY OF THE INVENTION

To accomplish the above and other objectives, the present invention comprises an improved waveguide slot array antenna system. The waveguide slot array antenna system may be advantageously used as part of a communications system disposed on a satellite.

The waveguide slot array antenna system comprises a feed waveguide having an input port and multiple output ports. A waveguide slot array having a plurality of slots formed therein is coupled to the feed waveguide. A waveguide lens comprising an array of rectangular waveguides is disposed adjacent to the waveguide slot array. The phase of each radiating waveguide of the waveguide lens is controlled to achieve radiation pattern shaping. This capability has not been achieved by conventional waveguide slot array designs.

Thus, in order to achieve control of the phase radiated from the waveguide slot array antenna system, the array of rectangular waveguides forms a waveguide lens in front of the plurality of radiating slots and is an integral part of the structure of the system. Inner dimensions of the rectangular waveguides are designed to provide a phase velocity inside each waveguide that results in the appropriate radiated phase at the output of the waveguides.

The advantage of using the present waveguide slot array antenna system is that the phase radiated by each rectangular waveguide is determined by design, and the radiation pattern that results from the combined contributions of the array can be shaped to demonstrate a complex radiation contour. This significantly increases the efficiency with which signals are directed to intended regions without coverage directed to unintended regions.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

By way of introduction, a conventional waveguide slot array uses a set of parallel waveguides with slots on a broadwall of the waveguides to form a two dimensional planar array of slots. The amplitude of excitation of each slot is determined by the offset of that slot from the centerline of the broadwall of the waveguide. The slots are spaced at half-waveguide wavelength intervals and adjacent slots are positioned on opposite sides of the centerline. This arrangement puts all slot radiation contributions in-phase because the current direction reversal in the waveguide current distribution of each half waveguide wavelength.

The conventional waveguide slot array is thus composed of a planar arrangement of radiating slots. The excitation for these slots is provided by a waveguide power division network and the radiating slots along a radiating guide are spaced at half waveguide wavelength intervals. This configuration requires that the slots are radiating in-phase contributions and the resulting radiation pattern is a simple shape such as circular or elliptical. Using this convention technology, the amplitude radiated by each slot is in fact controlled by design but the phase is restricted to the in-phase condition.

Figure 1:
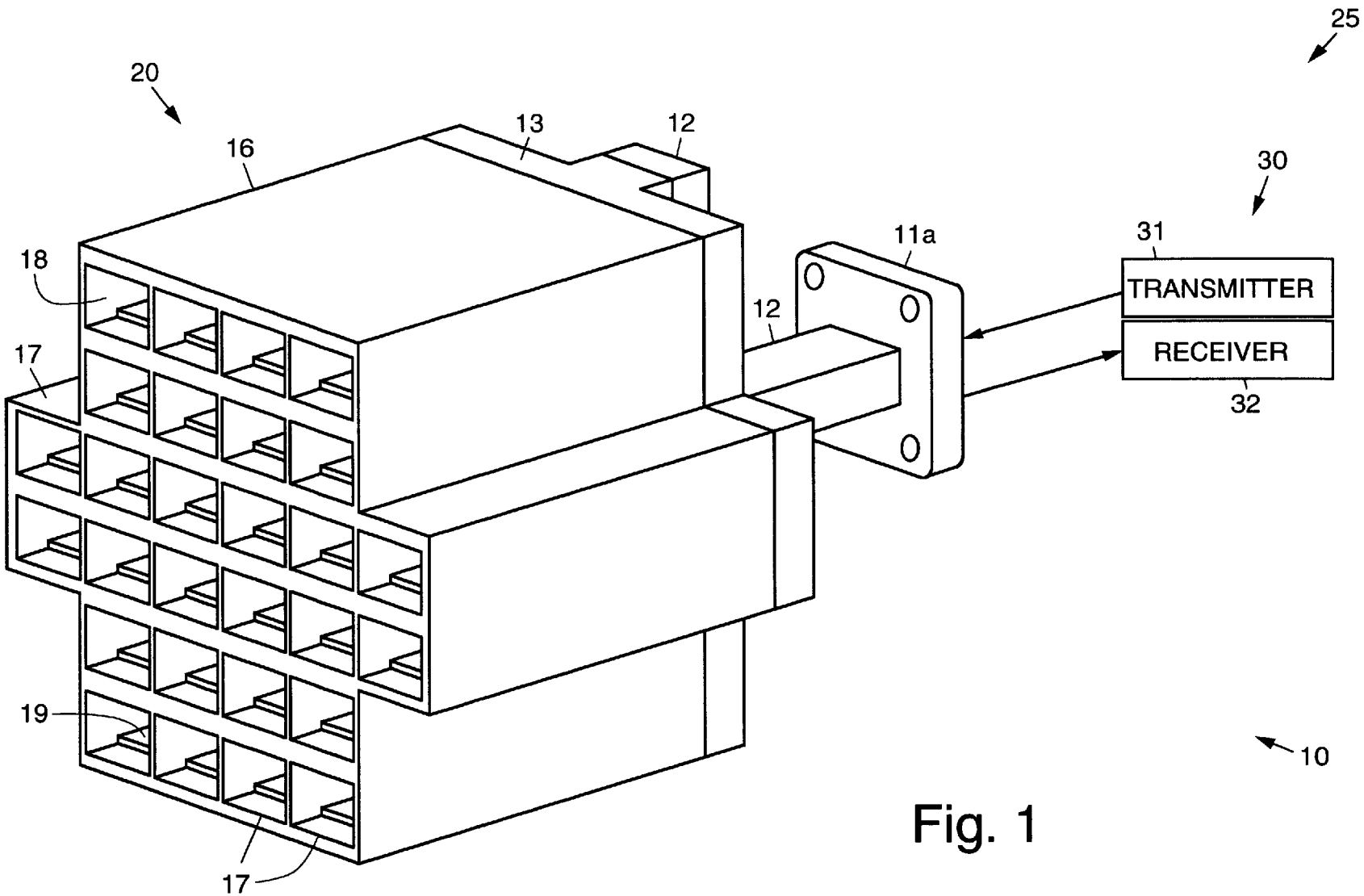
FIG. 1 illustrates a perspective view of an exemplary waveguide slot array antenna system in accordance with the principles of the present invention.
Figure 2:
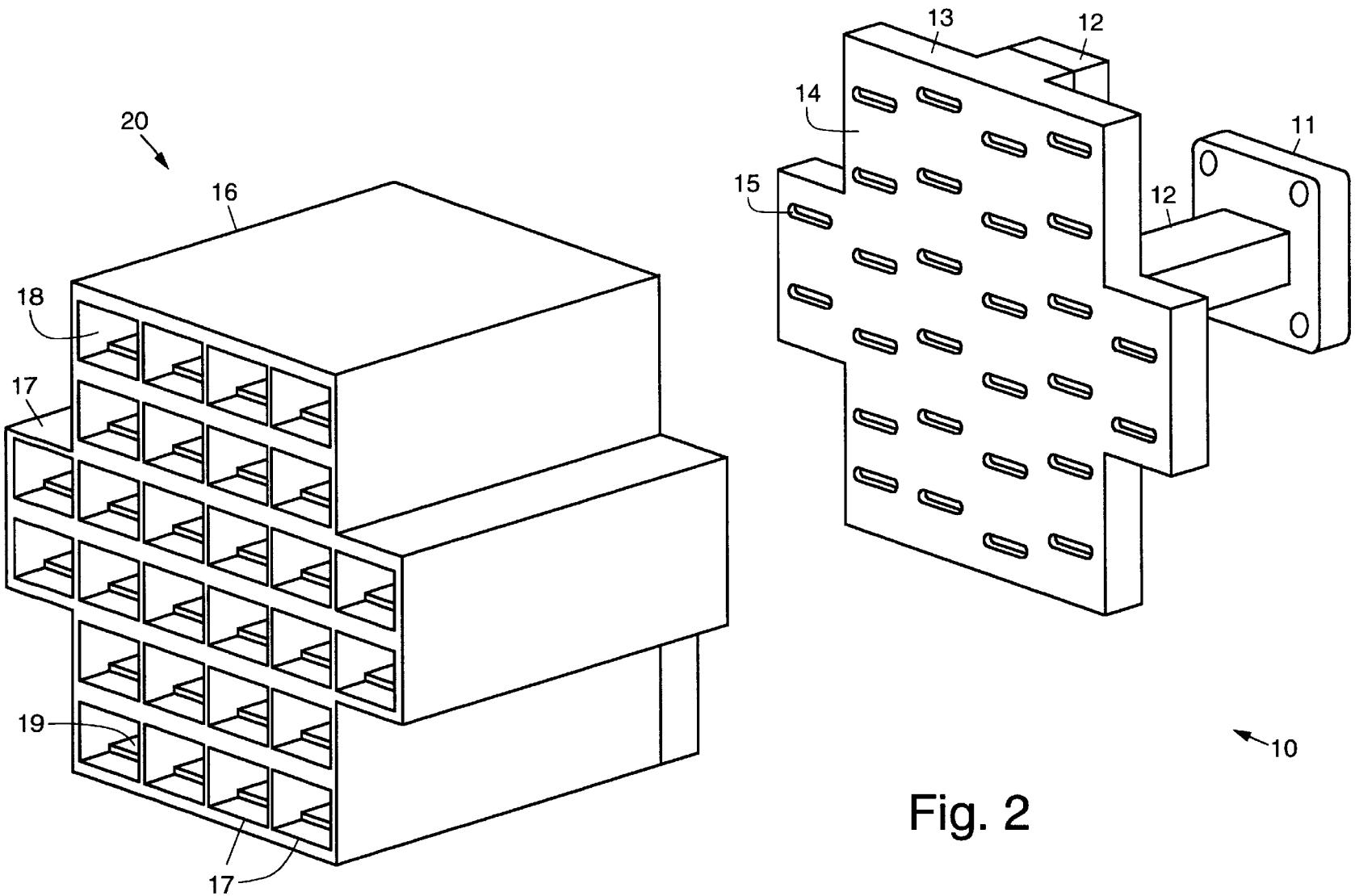
FIG. 2 is a front exploded view of the exemplary waveguide slot array antenna system shown in FIG. 1.
Figure 3:
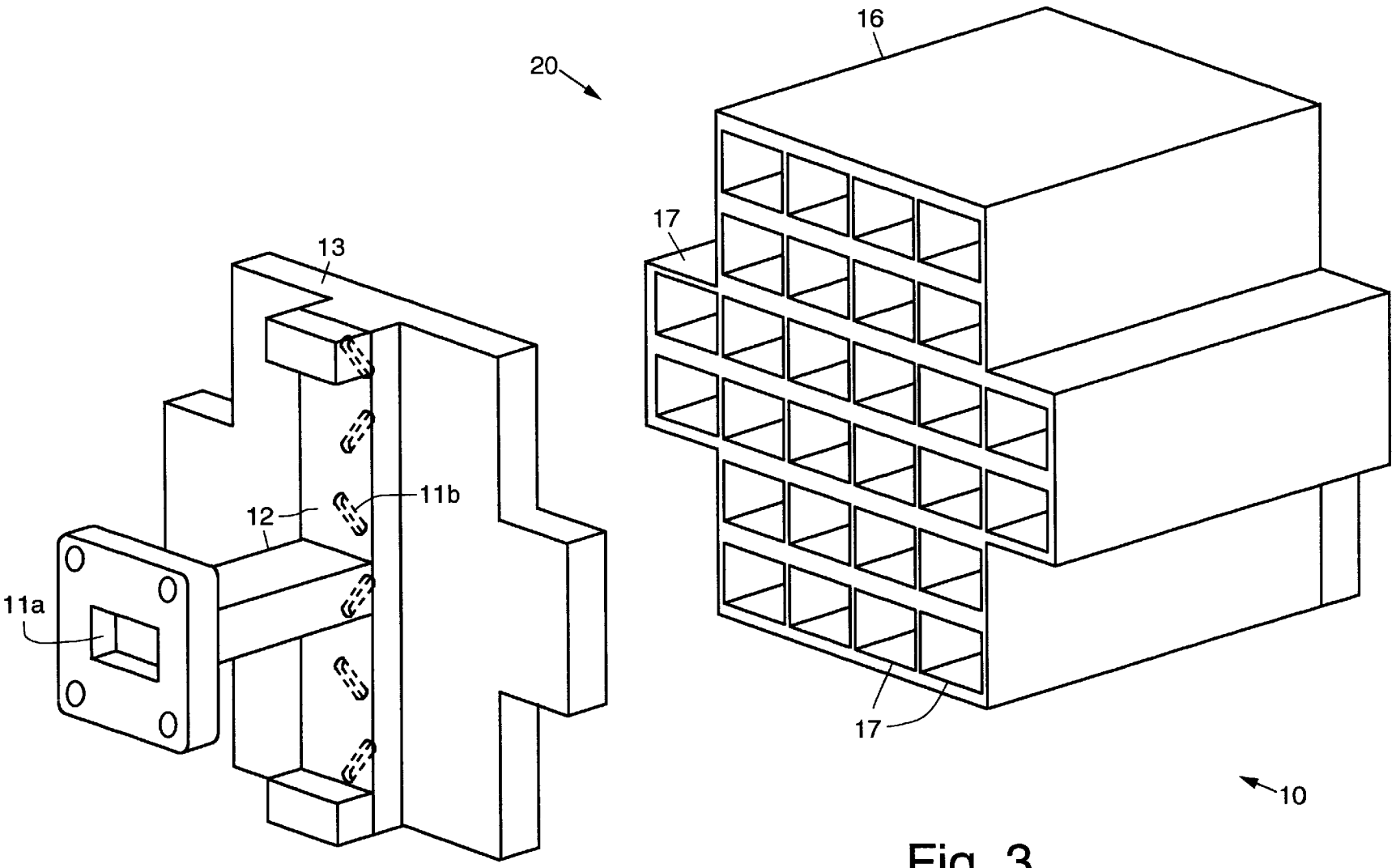
FIG. 3 is a rear exploded view of the exemplary waveguide slot array antenna system shown in FIG. 1.
Figure 4:
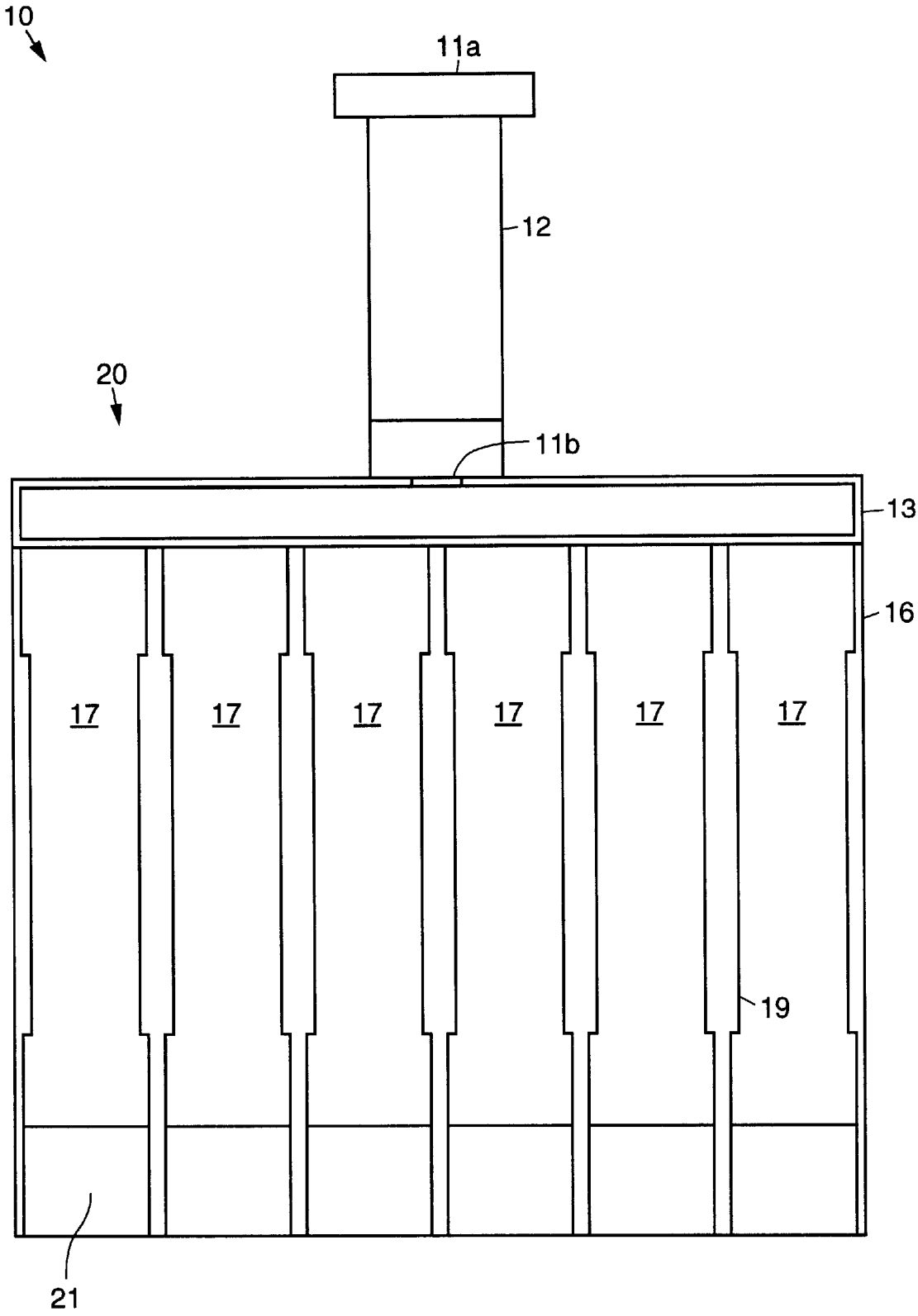
FIG. 4 is cross sectional side view of the exemplary waveguide slot array antenna system shown in FIG. 1.
Figure 5:
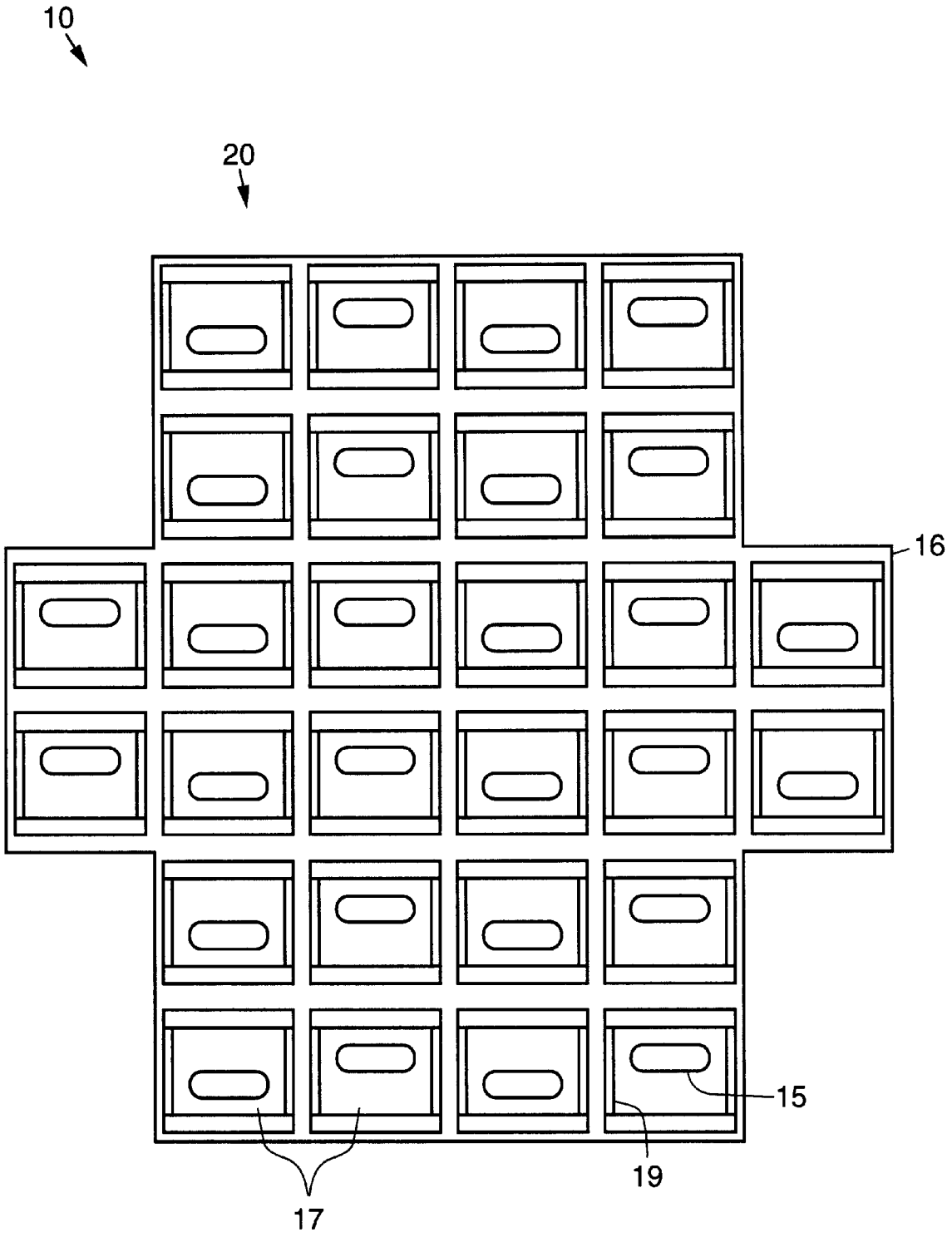
FIG. 5 is front view of the exemplary waveguide slot array antenna system shown in FIG. 1.

Referring now to the drawing figures, FIG. 1 illustrates a perspective view of an exemplary waveguide slot array antenna system 10 in accordance with the principles of the present invention. FIGS. 2 and 3 show front and rear exploded views of the exemplary waveguide slot array antenna system 10 shown in FIG. 1. FIGS. 4 and 5 show cross sectional side and front views of the exemplary waveguide slot array antenna system 10.

The exemplary waveguide slot array antenna system 10 illustrated in FIG. 1 is shown as having a "cross" or "plus" shape. However, it is to be understood that the exemplary waveguide slot array antenna system 10 may have any shape that a particular design requires. The composite radiation pattern is determined by both the array aperture outline shape and the amplitude and phase of each element contributing to the radiated field. Therefore, the present invention is not limited to the specific shape of the system 10 shown in FIG. 1.

The exemplary waveguide slot array antenna system 10 comprises a feed waveguide 12 having an input port 11*a* and multiple output ports 11*b* (FIGS. 3 and 4) that couples RF energy to and from a waveguide slot array 13. The waveguide slot array 13 has a surface 14 with a plurality of slots 15 (FIG. 2) formed therein. An array 16 of rectangular waveguides 17 is attached directly to the surface 14 and plurality of slots 15 of the waveguide slot array 13. The exposed openings 18 at the output end of each of the rectangular waveguides 17 comprises a radiating element 18 from which radiation is transmitted. Impedance matching sections 21 are disposed at the output end (the radiating end) of each of the rectangular waveguides 17.

Each rectangular waveguide 17 comprises a thin wall rectangular metallized waveguide structure having a step 19 or reduced width waveguide section 19, formed therein such that a first section of the waveguide 17 is offset from a second section thereof. This reduction of the broadwall dimension of the waveguide 17 determines the phase radiated from each waveguide 17. Respective adjacent ends of the first and second sections of the waveguide 17 are separated by a predetermined distance.

The respective slots 15 of the waveguide slot array 13 are offset from a centerline of the corresponding waveguide 17, which determines the amplitude of excitation. The slots 15 are spaced at half waveguide wavelength intervals and adjacent slots 15 are positioned on opposite sides of the centerline 14 of adjacent waveguides 17.

The exemplary waveguide slot array antenna system 10 may be advantageously employed with a communications system 30 disposed on a satellite 25 (generally designated). The communications system 30 comprises a transmitter 31 and/or a receiver 32 that are disposed on the satellite 25. The transmitter 31 and/or the receiver 32 are coupled to the input/output ports 11*a*, 11*b* of the feed waveguide 12.

The radiation pattern generated by each of the radiating elements 18 combines to produce a complex radiation pattern as the output of the waveguide slot array antenna system 10. The waveguide slot array antenna system 10 is capable of radiating a wide range of amplitudes and phases from each radiating element 18 and therefore achieving a complex radiation pattern.

The phase control that is a necessary part of the present invention is achieved by exciting the array 16 of rectangular waveguides 17 using the slots 15 of the waveguide slot array 13. The array 16 of rectangular waveguides 17 forms a waveguide lens 20 in front of the waveguide slot array 13 that performs the phase control by reduction of the broadwall dimension in each waveguide 17. The design of the slots 15 in the waveguide slot array 13 are designed to excite the rectangular waveguides 17 rather than radiate into free space.

To achieve control of the phase radiated from the waveguide slot array antenna system 10, inner dimensions of the rectangular waveguides 17 are designed to produce a phase velocity inside each waveguide 17 that results in the appropriate radiated phase at the output of each waveguide 17. In the waveguide slot array antenna system 10, the phase radiated by each rectangular waveguide 17 is determined by design, and the radiation pattern that results from the combined contributions of the waveguide slot array 13 may be shaped to demonstrate a complex radiation contour. This significantly increases the efficiency with which signals are directed to intended regions without coverage directed to unintended regions.

Thus, a stepped waveguide slot array antenna system having phase control and satellite communication system have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. An antenna system comprising:

a feed waveguide having an input port and multiple output ports;

a waveguide slot array having a plurality of slots formed therein that is coupled to the feed waveguide; and a waveguide lens disposed adjacent to the waveguide slot array.

2. The antenna system recited in claim 1 wherein the waveguide lens comprises an array of rectangular waveguides.

3. The antenna system recited in claim 2 further comprising impedance matching sections disposed at a radiating end of each of the rectangular waveguides.

4. The antenna system recited in claim 1 which is disposed on a satellite and is coupled to a communication system.

5. The antenna system recited in claim 1 wherein the communication system comprises a transmitter and a receiver that are selectively coupled to the input and output ports of the feed waveguide.

6. The antenna system recited in claim 2 wherein inner dimensions of the rectangular waveguides are designed to produce a phase velocity inside each waveguide that results in an appropriate radiated phase at the output of each waveguide and to thus control of the phase radiated from the antenna system.

7. A communications system for use on a satellite, comprising:

a transmitter;

a receiver; and an antenna system comprising a feed waveguide having an input port and multiple output ports selectively coupled to transmitter and receiver, and a waveguide slot array having a plurality of slots formed therein that is coupled to the feed waveguide, and a waveguide lens disposed adjacent to the waveguide slot array.

8. The communications system recited in claim 7 wherein the waveguide lens comprises an array of rectangular waveguides.

9. The communications system recited in claim 8 wherein the antenna system further comprises impedance matching sections disposed at a radiating end of each of the rectangular waveguides.

10. The communications system recited in claim 8 wherein inner dimensions of the rectangular waveguides are designed to produce a phase velocity inside each waveguide that results in an appropriate radiated phase at the output of each waveguide and to thus control of the phase radiated from the antenna system.

11. Apparatus comprising:

a satellite;

a communication system disposed on the satellite that comprises a transmitter and a receiver; and an antenna system comprising a feed waveguide having an input port and multiple output ports selectively coupled to transmitter and receiver, a waveguide slot array having a plurality of slots formed therein that is coupled to the feed waveguide, and a waveguide lens disposed adjacent to the waveguide slot array.

12. The apparatus recited in claim 11 wherein the waveguide lens comprises an array of rectangular waveguides.

13. The apparatus recited in claim 12 wherein the antenna system her comprises impedance matching sections disposed at a radiating end of each of the rectangular waveguides.

14. The apparatus recited in claim 12 wherein inner dimensions of the rectangular waveguides are designed to produce a phase velocity inside each waveguide that results in an appropriate radiated phase at the output of each waveguide and to thus control of the phase radiated from the antenna system.

* * * * *